US005895555A

United States Patent [19]

Van Den Bergh

[11] Patent Number: 5,895,555

[45] Date of Patent: Apr. 20, 1999

[54] LABELLING MACHINE

[75] Inventor: Marc Frans Stefaan Maria Van Den Bergh, Waasmunster., Belgium

[73] Assignee: Van Den Bergh Engineering, N.V., Sint-Niklaas, Belgium

[21] Appl. No.: 08/977,500

[22] Filed: Nov. 24, 1997

[30] Foreign Application Priority Data

Dec. 3, 1996 [BE] Belgium ..... 09601004

[51] Int. Cl.[6] ..... B65C 9/00

[52] U.S. Cl. ..... 156/556; 156/361; 156/542; 156/568

[58] Field of Search ..... 156/556, 541, 156/542, 567, 568, 361, 362, 363, 364

[56] References Cited

U.S. PATENT DOCUMENTS

| | | | |
|---|---|---|---|
| 287,957 | 11/1883 | Osborne | 226/1 |
| 4,347,094 | 8/1982 | Watanabe | 156/387 |
| 4,842,660 | 6/1989 | Voltmer et al. | 156/542 X |
| 5,387,298 | 2/1995 | Takagi et al. | 156/47 |

FOREIGN PATENT DOCUMENTS

| | | |
|---|---|---|
| 28 53 033 | 6/1980 | Germany . |
| 91 02 676 | 5/1991 | Germany . |
| 2 221 206 | 1/1990 | United Kingdom . |

*Primary Examiner*—James Engel
*Attorney, Agent, or Firm*—Bacon & Thomas, PLLC

[57] ABSTRACT

A labelling machine is provided for the application of self-adhesive labels spaced at intermediate distances and having adhesive undersides which are disposed successively on a band-shaped substrate onto a continuously moving strip. The machine includes a peeling and applying unit comprising a peeling mechanism which peels the labels off the substrate and a transport mechanism which transports the substrate to the peeling mechanism and applies the peeled-off labels onto the strip. The transport mechanism includes: at least one transport element which transports the substrate with labels to the peeling mechanism and the peeled-off labels to the strip; a driving mechanism adapted to drive the transport element with a variable speed; and a substrate/label holding arrangement which non-mechanically holds at least said peeled-off labels against the transport element with the adhesive undersides directed away from the transport element until the peeled-off labels are applied onto the strip.

19 Claims, 4 Drawing Sheets

40
24
36
34
35
32
33
3
31
4
30
20
38
39
44
16
26
23
13
18
15
29
7
28
27
21
14
22
42
19
8

LABELLING MACHINE

BACKGROUND OF THE INVENTION

1. Field of the Invention

This invention relates to a labelling machine for the application of self-adhesive labels spaced at intermediate distances and which are disposed successively on a band-shaped substrate onto a continuously moving strip. More particularly, the machine comprises a peeling and applying unit including a peeling mechanism which peels the labels off the substrate and a transport mechanism which transports the substrate to the peeling mechanism and applies the peeled labels onto the strip.

2. Description of the Related Art

Such machines are used, for example, for applying address labels on letters which are printed as a continuous strip and subsequently cut to length.

The problem with such machines is that the labels are situated on the substrate at a much smaller distance, mostly only 2 to 4 mm, from each other than the distance which must remain between them when they are applied onto the strip which may, for example, be 30 cm.

In known labelling machines, the peeling mechanism is a knife situated directly above the strip, such that the peeled labels directly drop onto the strip where they are pressed on this strip by means of a roller. The transport mechanism consists of a winding mechanism with a driven roller on which the empty substrate is wound up. Consequently, the substrate with labels is wound off from the roll on which it had been wound up and is drawn over the knife.

In these known labelling machines, the aforementioned problem is solved by driving the winding mechanism intermittently and thus winding the substrate successively over a distance and over the knife.

This means that each time a label is to be applied onto the strip, the roll of the winding mechanism during actual application must be accelerated very fast from a standstill up to a circumferential speed to make the speed of the substrate equal to the speed of the strip. The roll of the winding mechanism must move for a short period of time with this speed, and thereafter must come back to a standstill very fast.

This sequence of accelerations and decelerations of the band with labels causes it to be impossible to realize high speeds of the strip. This strip, coming from a printing machine with a speed of 375 m/min, must be decelerated.

SUMMARY OF THE INVENTION

This invention aims toward a labelling machine which does not show this disadvantage and other disadvantages and allows a very high speed of the strip on which the labels must be applied.

According to the invention, this aim is achieved in that the transport mechanism which transports the substrate to the peeling mechanism and transports the peeled-off labels to the strip comprises at least one transport element for the transport of the substrate with labels to the peeling mechanism and a peeled-off label to the strip; a driving mechanism adapted to drive the transport element with a variable speed; and a substrate/label holding arrangement which non-mechanically holds at least a peeled-off label against the transport element with its adhesive underside directed away from the transport element until the peeled-off label is applied onto the strip.

Without the substrate/label holding arrangement, transportation of the substrate by a transport element which is quickly accelerated and decelerated is not possible in a precise manner because of slippage which inevitably will be created.

Without the substrate/label holding arrangement, the transport element cannot transport peeled-off labels. Holding means requiring a direct contact with the labels are not useful because the peeled-off labels are transported through the transport element with the adhesive undersides exposed.

Preferably, the substrate/label holding arrangement is an arrangement for electrostatically charging at least a part of an exterior surface of the transport element, for example, for charging an electrically nonconducting exterior surface of the transport element.

The transport element may comprise a drum and the driving mechanism may comprise an electric motor which is situated within the drum.

The drum may be made in a light manner from composite material, synthetic material reinforced with fibers, which is coated at the exterior surface with an electrostatically chargeable layer.

In a particular embodiment of the invention, the transport mechanism comprises a first transport element which transports the substrate with labels and a second transport element which transports the peeled-off labels with the adhesive undersides directed away from the second transport element from the first transport element to the strip, the peeling mechanism being located between the first and second transport elements, the driving mechanism being arranged to separately drive the two transport elements with a variable speed such that the label disposed on the substrate first is accelerated by the first transport element to an intermediate speed and, after having been peeled off, is further accelerated to a desired speed for being applied onto the strip, and the substrate/label holding arrangement is at least part of the second transport element to hold the peeled-off labels against the second transport element with the adhesive undersides directed away from said second transport element until the peeled-off labels are applied onto the strip.

A peeled-off label is not directly applied onto the strip, but transported by the second transport element with the adhesive undersides directed away from the second transport element. The acceleration of the labels may be performed in two steps: a first step by the first transport element and a second step by the second transport element. As a result, the two transport elements each must perform a smaller acceleration than is the case when a single transport element must realize the entire acceleration.

The driving mechanism preferably is such that a circumferential speed of the first transport element may vary between a standstill and a maximum circumferential speed and a circumferential speed of the second transport element may vary between a circumferential speed which is equal to or smaller than the maximum circumferential speed of the first transport element and the desired circumferential speed which coincides with the speed of the label during application onto the strip, whereby, at the moment when the label is peeled off, both transport elements have the same circumferential speed.

The second transport element may stay in motion with as its minimum circumferential speed the maximum circumferential speed of the first transport element.

The labelling machine may comprise a vacuum chamber which is positioned before the transport element and a supply mechanism for feeding the substrate with labels to the vacuum chamber in such a manner that a buffer supply of the substrate with labels is always present therein.

BRIEF DESCRIPTION OF THE DRAWINGS

With the intention of better showing the characteristics of the invention, preferred embodiments of a labelling machine according to the invention are described hereafter, as examples without any limitative character, reference being made to the accompanying drawings, wherein.

DETAILED DESCRIPTION OF THE PREFERRED EMBODIMENTS

Figure 1:
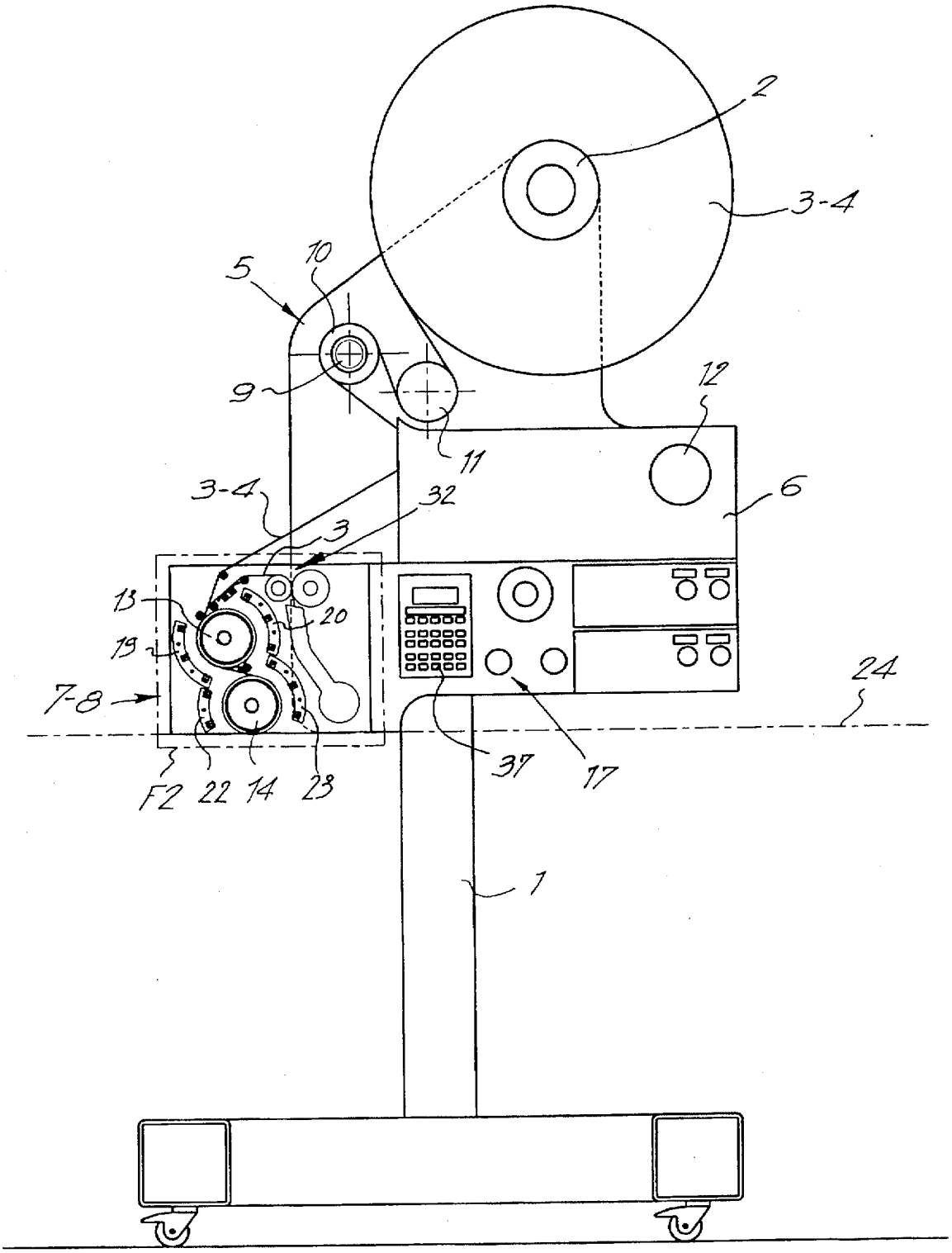
FIG. 1 schematically shows a front elevational view of a labelling machine according to the invention.

A labelling machine represented in FIG. 1 comprises a movable frame 1 on which, substantially from top to bottom, the following parts are mounted: a carrier 2 for a wound-up band-shaped substrate 3 with self-adhesive labels 4 having adhesive undersides, a supply mechanism 5 for substrate 3, a vacuum chamber 6, and a peeling and applying unit consisting of a peeling mechanism 7 and a transport mechanism 8.

Carrier 2 is a horizontal shaft which is fixed at the top of frame 1 and upon which band-shaped substrate 3 is wound-up upon itself or upon a roller. Substrate 3 consists, for example, of paper coated with silicones and labels 4 which are disposed thereupon at a small mutual distance of several millimeters, for example 3.16 mm, and which are directed with their longitudinal directions perpendicular to the longitudinal direction of substrate 3.

Supply mechanism 5 comprises a drum 10 which is borne on frame 1 and driven by an electric motor 9 and a tensioning roller 11 between drum 10 and carrier 2.

Vacuum chamber 6 is connected to a vacuum pump 12 and is sufficiently large to contain a buffer supply of substrate 3 with labels 4. In vacuum chamber 6, detectors, not represented in the figures, such as photocells, are installed which control motor 9 of supply mechanism 5 as a function of the supply of substrate 3 in vacuum chamber 6.

Transport mechanism 8 comprises two transport elements, namely a first transport drum 13 and a second transport drum 14, between which peeling mechanism 7 is situated.

Transport mechanism 8 also comprises a driving mechanism 15-16-17 for driving transport drums 13 and 14, including motors 15 and 16 and a control 17 for these motors.

Furthermore, transport mechanism 8 includes a substrate/label holding arrangement part of the first transport drum 18-19-20 which holds substrate 3 non-mechanically against first transport drum 13 and a substrate/label holding arrangement part of the second transport drum 21-22-23 which holds peeled-off labels 4 non-mechanically against second transport drum 14 until they are applied onto a strip 24.

Strip 24, for example, is a chain form onto which, at regular distances from each other, for example on each page, labels 4 must be glued.

Figure 2:
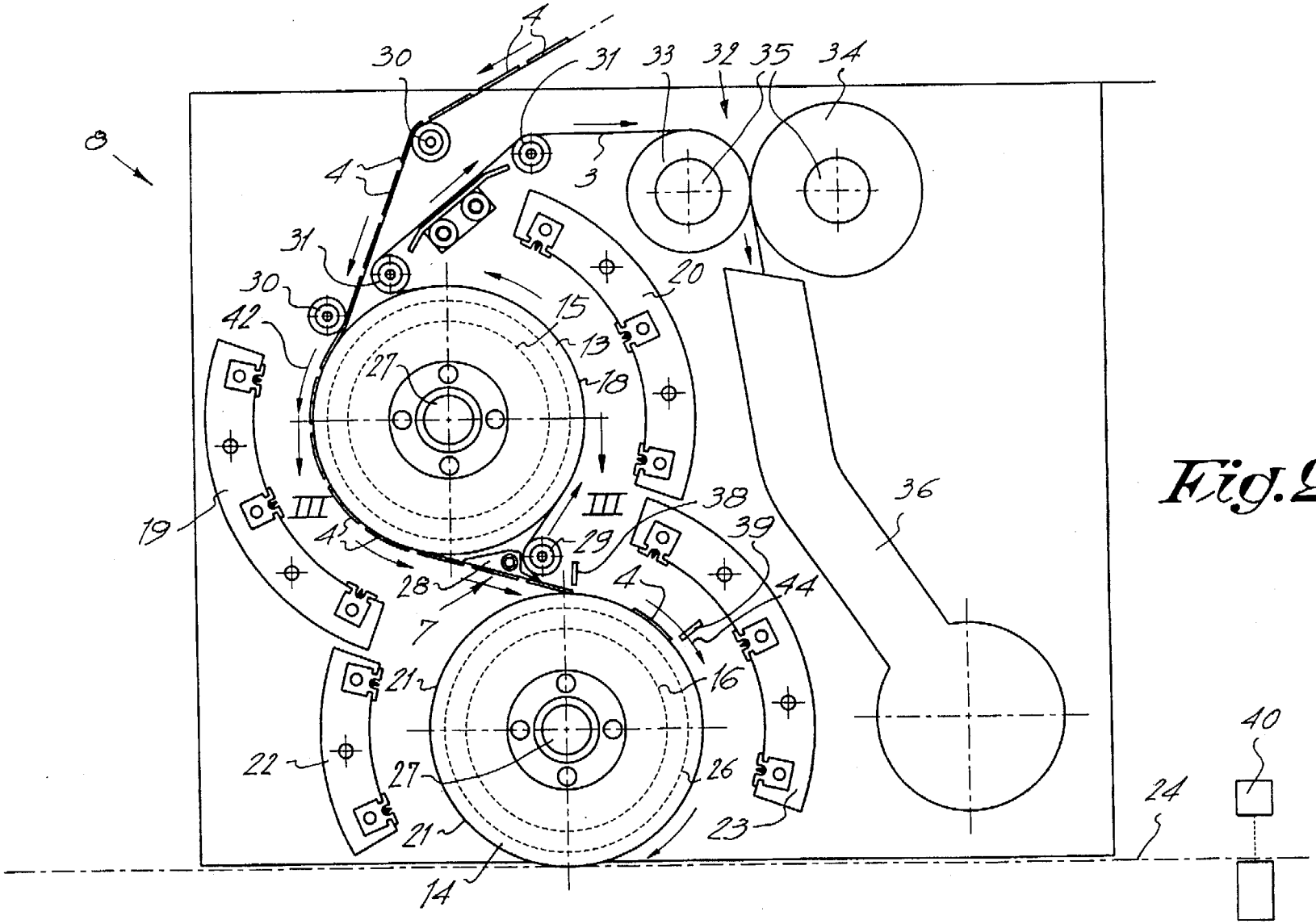
FIG. 2, at a larger scale, shows the part which is indicated by F2 in FIG. 1.

As shown in detail in FIG. 2, substrate/label holding arrangement part of the first transport drum 18-19-20 is an arrangement for electrostatically charging an exterior surface of first transport drum 13, namely its shell, comprising an electrically nonconductive and electrostatically chargeable coating 18 of the shell of first transport drum 13 and two electrodes 19 and 20 between which a voltage field is created, which are arranged diametrically opposed to each other at a small distance from first transport drum 13 in such a manner that one of the electrodes is situated opposite a part of first transport drum 13 with which substrate 3 is in contact during its transport.

Electrodes 19 and 20 are in contact with a voltage supply, not represented in the drawings, having a very high voltage of, for example, 15 kV which imparts an opposed, cyclically altering polarity to electrodes 19 and 20. Electrodes 19 and 20 cause a positive and a negative voltage or electrostatic charge on different parts of coating 18 of first transport drum 13.

Electrostatically chargeable coating 18, in particular, is a coating from synthetic material, for example, a foil of high-pressure polyethylene.

Substrate/label holding arrangement part of the second transport drum 21-22-23, in an analogous manner, is an arrangement for electrostatically charging an exterior surface of second transport drum 14, comprising a similar electrically nonconductive and electrostatically chargeable coating 21 of a shell of second transport drum 14 and two electrodes 22 aid 23 between which a cyclically altering voltage field is formed. One electrode is arranged opposite to a part of second transport drum 14 along which a label 4 is transported and the other electrode is situated diametrically opposed thereto.

In a variant, the electric charging of electrostatically chargeable coating 18 or 21 may be obtained by using only a single electrode which, for the most part, surrounds transport drum 13 or 14, respectively, whereas a discharger is then installed between the extremities of this electrode.

Transport drums 13, 14 comprise a very thin wall with, for example, a thickness of 0.6 mm, of a very strong and light-weight material, in particular a composite material, synthetic material reinforced with fibers such as glass fibers or carbon fibers, whereby the shell is coated at its exterior with coating 18, 21, respectively.

The total weight of each transport drum is extremely small, for example, less than 50 gm, so that the inertia of each transport drum also is very small.

Figure 3:
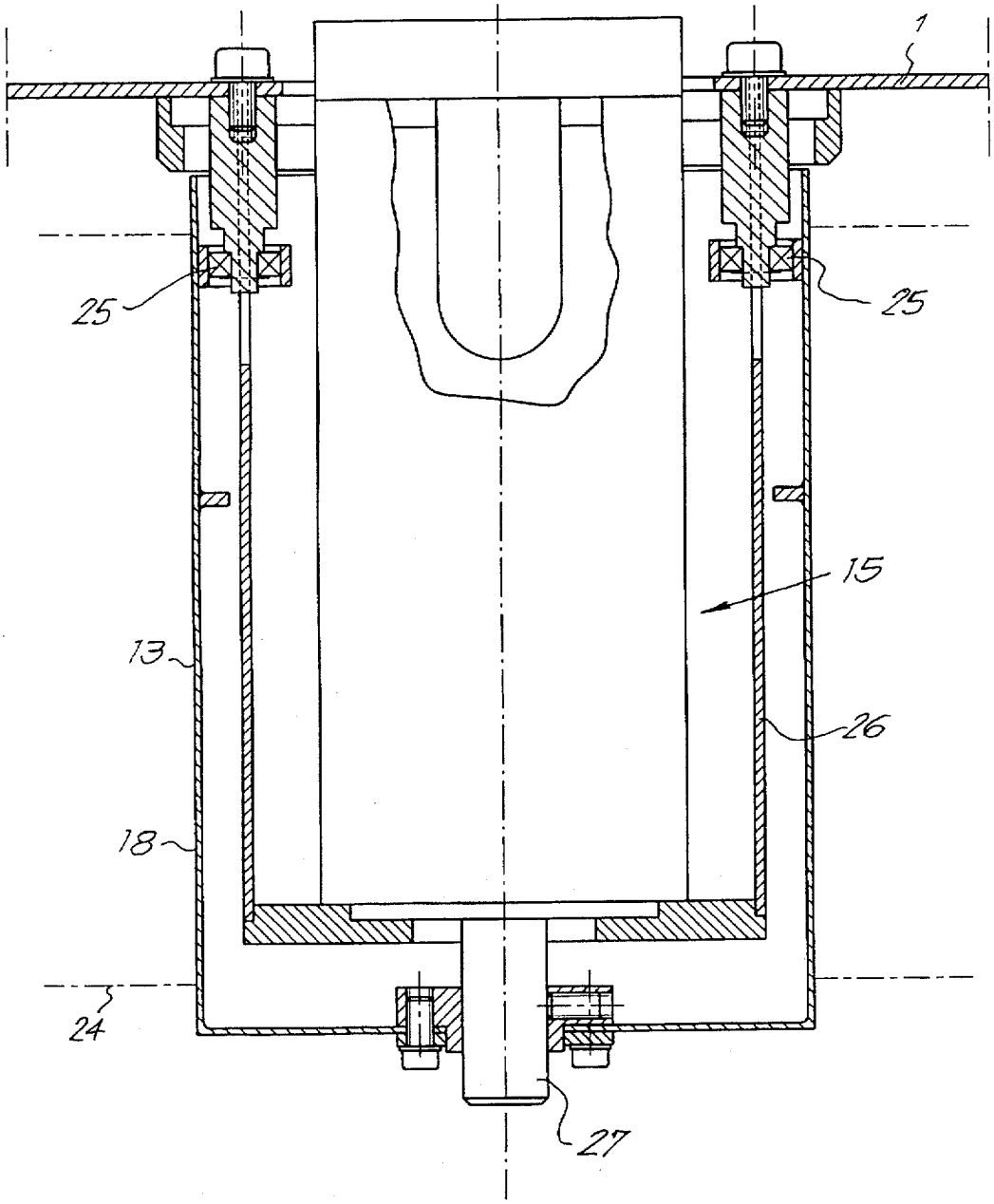
FIG. 3 shows a cross-section according to the line III—III in FIG. 2, drawn at a still larger scale.

First transport drum 13, as represented in detail in FIG. 3, is open at one extremity and borne in the proximity of this extremity by bearings 25 around a housing 26 of motor 15 driving first transport drum 13 and situated therein.

Motor 15 is fixed by the intermediary of housing 26 at frame 1. A shaft 27 of motor 15 is fixed at a closed extremity of first transport drum 13.

Second transport drum 14 is identical to first transport drum 13 and mounted turnable in the same manner around motor 16 driving it.

The speed with which motor 15 drives first transport drum 13 or motor 16 drives second transport drum 14 might be restricted by overheating of motor 15, 16. To allow for a higher speed in such cases, a cooling mechanism may be provided for undercooling motor 15, 16 to negative temperatures.

Peeling mechanism 7 comprises a knife 28, which is fixed at frame 1 between transport drums 13 and 14 practically against second transport drum 14, and which has an edge around which substrate 3 by a roller 29 placed above knife 28 is forced to bend over an angle of approximately 180 degrees.

Between its edge and first transport drum 13, knife 28 forms a guide for substrate 3 with labels 4.

Above first transport drum 13, a number of guiding rollers 30 is installed for guiding substrate 3 from vacuum chamber 6 to first transport drum 13 and a number of guiding rollers 31 for guiding empty substrate 3 starting from roller 29 over a part of the circumference of first transport drum 13 and to a discharge mechanism 32 comprising two rollers 33 and 34 between which substrate 3 is clamped and which are driven by motors 35.

In a variant, rollers 33 and 34 may be replaced by knives.

Beneath discharge mechanism 32, a discharge channel 36 is situated which ends up in a waste container or at a windup mechanism for empty substrate 3.

Control 17 controls motors 15 and 16 for driving transport drums 13 and 14 separately, as a function of data which are put in by the user on a control panel 37 connected therewith and as a function of data from two detectors 38 and 39 and an encoder 40.

Detectors 38 and 39 which detect labels 4 and, for instance, may be photocells, are respectively placed just past the edge of knife 28 where a peeled-off label 4 touches second transport drum 14 and at a distance therefrom opposite to second transport drum 14.

Encoder 40 is situated opposite to strip 24 and detects markings in order to give information of the position and, thereby, of the speed of strip 24.

Control 17 controls motors 15 and 16 in such a manner that transport drums 13 and 14 are driven in a contrary sense with varying speed, whereby first transport drum 13 may be accelerated from a standstill to a well-defined speed and second transport drum 14 may be accelerated from approximately this well-defined speed to its circumferential speed which is equal to the speed of strip 24, as will be described hereafter in a more detailed manner.

The functioning of the labelling machine described above is simple and as follows.

A roll of substrate 3 with labels 4 is placed onto carrier 2, and the front end of substrate 3 is brought over supply mechanism 4 and vacuum chamber 6 up into peeling and applying unit 7–8.

Strip 24 on which labels 4 are attached is guided along the bottom side of second transport drum 14.

On control panel 37, the various parameters are regulated, such as dimensions of labels 4, their mutual distance and the distance between the labels on strip 24.

After the machine has been started, supply mechanism 5 provides a sufficient supply of substrate 3 in vacuum chamber 6 in order to provide a tensionless supply of substrate 3 to transport mechanism 8.

Figure 4:
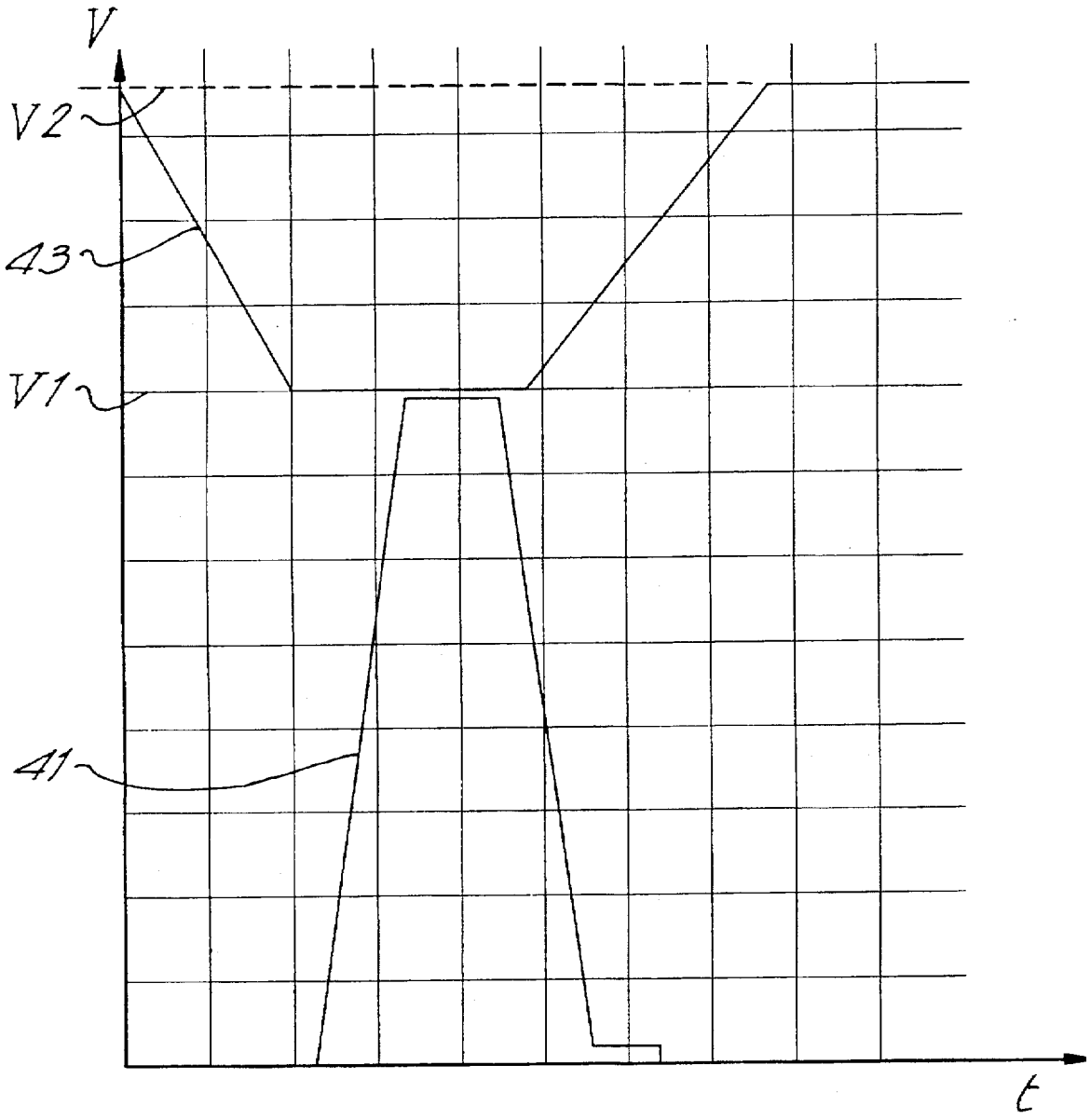
FIG. 4 shows a graph of the accelerations of the motors of the labelling machine of FIGS. 1 to 3 as a function of time.

Control 17 controls motor 15 of first transport drum 13 in such a manner that the rotational speed thereof varies according to a line 41 in the diagram represented in FIG. 4 which shows the number of revolutions per minute V as a function of the time t in milliseconds.

As a result, substrate 3 with labels 4 disposed thereon, which due to the electrostatic charging of coating 18 by the electric field between electrodes 19 and 20 is drawn against first transport drum 13, is moved along with first transport drum 13 without any slippage, as indicated in FIG. 2 by arrows 42. Hereby, first transport drum 13 is accelerated from a standstill to a maximum speed V1 which corresponds to an intermediate speed of label 4 and is, for example, 800 revolutions per minute.

This acceleration is started by control 17 at the moment when it receives a signal from encoder 40. Second transport drum 14 is revolved at its maximum speed for a short period of time and subsequently stopped.

The entire acceleration and deceleration of first transport drum 13 takes place in several milliseconds and corresponds to the dimension according to the circumference of first transport drum 13 of one label and an intermediate distance between two labels.

This means that during this cycle, one label is drawn past the edge of knife 28 and therefore one label is peeled off by knife 28 and, in the period of time in which first transport drum 13 revolves with its maximum speed V1, the one label thus moving at the intermediate speed, is transferred to second transport drum 14.

Empty substrate 3 is moved over the same distance as label 4 during the above-described displacement thereof, and empty substrate 3, by the electrostatic charge of coating 18 of first transport drum 13, is drawn against the latter, at the opposite side in respect to substrate 3 with labels 4, and thereby brought to supply mechanism 32.

At the moment of the transfer of peeled-off label 4, control 17 is controlling motor 16 of second transport drum 14 in such a manner that second transport drum 14 revolves in the opposite sense at the aforementioned maximum speed and therefore the circumferential speed of second transport drum 14 is equal to V1.

Just before that, as represented by line 43 in the diagram of FIG. 4, second transport drum 14 has been decelerated from a higher number of revolutions, for example, 1150 revolutions per minute, to the aforementioned speed.

As soon as detector 38 detects that label 4 has passed, which means that label 4 is situated completely on second transport drum 14 with its adhesive underside directed away from second transport drum 14, control 17 accelerates motor 16 up to its maximum speed V2.

By the electrostatic charge of coating 21 by the electric field between electrodes 22 and 23, label 4 is drawn against second transport drum 14 and moved along with second transport drum 14, as represented in FIG. 2 by the arrows.

The acceleration starts when detector 29 detects a front end of label 4 after a revolution of approximately 38° of second transport drum 14, after which second transport drum 14 is driven with its maximum speed V2 corresponding to a circumferential speed which is equal to the speed of strip 24, during a sufficient period of time so that label 4 will reach strip 24 and, by the contact of strip 24 with second transport drum 14, will be applied onto strip 24.

Subsequently, control 17 commands the deceleration of motor 16 down to the intermediate speed V1, as represented by line 43 in FIG. 4.

The above-described cycle is repeated for the application of successive labels 4 on strip 24.

The speeds of transport drums 13 and 14 are mutually coordinated by control 17 in such a manner that label 4 is thus first accelerated to an intermediate speed on first transport drum 13, is taken over by second transport drum 14 at this speed and subsequently is further accelerated to the speed of strip 24 in order to be applied onto continuously moving strip 24.

Because of the acceleration in two steps and the small inertia of transport drums 13 and 14 which enable a fast acceleration, the speed of strip 24 may be relatively high.

In an alternative embodiment, drum 10 of supply mechanism 5 may be constructed in an analogous manner around motor 9, such as transport drums 13 and 14, and thus also comprise an electrostatically chargeable coating which may be charged by electrodes.

It is not necessary that substrate 3 with labels 4 is held against a part of first transport drum 13 by electrostatic charging. Other means may be applied to this end insofar they offer little or no resistance against the speed alterations of first transport drum 13 or, in other words, do not directly touch this substrate.

The same is valid for labels 4 against second transport drum 14. However, it has to be considered that the label is directed with its adhesive underside towards the outside and thereby no elements may be brought against the adhesive underside.

Thus, in an alternative embodiment, the substrate/label holding arrangement may be formed by an arrangement for creating a vacuum at the inside of transport drum 13, 14 which then is provided with openings to the outside.

This invention is in no way limited to embodiments described heretofore and represented in the figures; on the contrary, such a labelling machine may be constructed in many variants without leaving the scope of the invention.

I claim:

1. A labelling machine for applying self-adhesive labels, which are successively disposed on a band-shaped substrate, onto a continuously moving strip, comprising:

a peeling and applying unit including a peeling mechanism which peels self-adhesive labels having adhesive undersides off a band-shaped substrate and a transport mechanism which brings said substrate to said peeling mechanism and applies said peeled-off labels onto a continuously moving strip, said transport mechanism comprising first and second transport elements which transport said substrate with said labels to said peeling mechanism and said peeled-off labels to said strip, respectively;

a driving mechanism adapted to separately drive said transport elements with variable speeds; and a substrate/label holding arrangement which non-mechanically holds said substrate against said first transport element and said peeled-off labels against said second transport element with said adhesive undersides directed away from said second transport element until said peeled-off labels are applied onto said strip.

2. A labelling machine according to claim 1, wherein said substrate/label holding arrangement includes an electrostatic charger that electrostatically charges at least part of an exterior surface of each of said transport elements.

3: A labelling machine according to claim 2, wherein said exterior surfaces of said transport elements are electrically nonconductive.

4. A labelling machine according to claim 3, wherein said substrate/label holding arrangement comprises: an electrostatically chargeable coating on each of said transport elements; and two electrodes positioned opposing each other at opposite sides of each of said transport elements.

5. A labelling machine according to claim 1, wherein said substrate/label holding arrangement is arranged to create a vacuum inside said transport elements and wherein said transport elements each have a plurality of openings at an exterior surface thereof which cooperate with said vacuum.

6. A labelling machine according to claim 1, wherein said first and second transport elements comprise transport drums.

7. A labelling machine according to claim 6, wherein said driving mechanism comprises an electric driving motor installed inside each of said transport drums.

8. A labelling machine according to claim 6, wherein said transport drums are made of composite material.

9. A labelling machine according to claim 7, wherein said transport drums are made of composite material.

10. A labelling machine according to claim 6, wherein said driving mechanism drives each of said transport drums in an opposite direction of rotation relative to the other.

11. A labelling machine according to claim 1, wherein said first transport element transports said substrate with said labels and said second transport element transports said peeled-off labels from said first transport element to said strip, said peeling mechanism being located between said first and second transport elements, said driving mechanism being arranged to separately drive said first and second transport elements with variable speeds such that a label disposed on said substrate first is accelerated by said first transport element to an intermediate speed and then after being peeled off is further accelerated by said second transport element to a desired speed for application onto said strip.

12. A labelling machine according to claim 11, wherein said driving mechanism includes a controller causing said first and second transport elements to be driven such that a circumferential speed of said first transport element is varied between a standstill and a maximum circumferential speed, such that a circumferential speed of said second transport element is varied between a circumferential speed which is not greater than said maximum circumferential speed of said first transport element and a desired circumferential speed which coincides with the speed of said label while being applied to said strip, and such that said first and second transport elements have the same circumferential speed when said label is peeled off.

13. A labelling machine according to claim 11, wherein said first and second transport elements comprise transport drums and said driving mechanism drives each of said transport drums in an opposite direction of rotation relative to the other.

14. A labelling machine according to claim 11, wherein said substrate/label holding arrangement comprises at least part of said second transport element.

15. A labelling machine according to claim 14, wherein said substrate/label holding arrangement comprises part of said first transport element.

16. A labelling machine according to claim 15, wherein said substrate/label holding arrangement part of said first transport element is substantially identical to said substrate/label holding arrangement part of said transport element.

17. A labelling machine according to claim 11, wherein said driving mechanism comprises a control connected to an encoder which detects data from said strip and two detectors which are positioned next to said second transport element, one of said detectors being positioned next to a point at which said peeled-off label comes into contact with said second transport element.

18. A labelling machine according to claim 1, further comprising:

a vacuum chamber which precedes said first transport element and supplies said substrate with said labels thereto; and a supply mechanism for feeding said substrate with said labels to said vacuum chamber such that a buffer supply of said substrate with said labels is established and maintained in said vacuum chamber.

19. A labelling machine according to claim 1, wherein said first transport element transports said substrate with said labels and said second transport element transports said peeled-off labels from said first transport element to said strip, said peeling mechanism being located between said first and second transport elements, said driving mechanism being arranged to separately drive said first and second transport elements with variable speeds such that a label disposed on said substrate first is accelerated by said first transport element to an intermediate speed and then after being peeled-off is transported by said second transport element at a desired speed for application onto said strip.

* * * * *